US005742959A

United States Patent [19]

Froelich

[11] Patent Number: 5,742,959

[45] Date of Patent: Apr. 28, 1998

[54] MEDICAL BED WITH OPENABLE TOP RAIL

[76] Inventor: Staci J. Froelich, 6716 Cockerille Ave., Takoma Park, Md. 20912

[21] Appl. No.: 802,945

[22] Filed: Feb. 21, 1997

[51] Int. Cl.[6] ..... A47D 7/01; A47D 7/02

[52] U.S. Cl. ..... 5/93.1; 5/429; 5/430

[58] Field of Search ..... 5/93.1, 100, 425, 5/428, 429, 430

[56] References Cited

U.S. PATENT DOCUMENTS

| | | | |
|---|---|---|---|
| 1,649,754 | 11/1927 | Summerson . | |
| 2,059,240 | 11/1936 | Johnston | 5/100 |
| 2,442,048 | 5/1948 | Kroll et al. | 5/100 |
| 2,689,960 | 9/1954 | Lax | 5/93.1 |
| 2,901,755 | 9/1959 | Wood, Jr. | 5/93.1 |
| 3,026,543 | 3/1962 | McPhaden | 5/100 |
| 3,032,781 | 5/1962 | Constanti | 5/100 |
| 3,045,259 | 7/1962 | Mayer | 5/100 |
| 3,351,961 | 11/1967 | Daniels et al. . | |
| 3,680,155 | 8/1972 | McMann . | |
| 3,797,053 | 3/1974 | Mamo . | |
| 4,525,883 | 7/1985 | Necowitz . | |
| 4,959,878 | 10/1990 | Essek | 5/425 |
| 5,381,571 | 1/1995 | Gabhart | 5/430 |

FOREIGN PATENT DOCUMENTS

| | | | |
|---|---|---|---|
| 232887 | 4/1925 | United Kingdom | 5/93.1 |
| 546053 | 6/1942 | United Kingdom | 5/93.1 |
| 688994 | 3/1953 | United Kingdom | 5/100 |

*Primary Examiner*—Alexander Grosz
*Attorney, Agent, or Firm*—Fay, Sharpe, Beall, Fagan, Minnich & McKee

[57] ABSTRACT

A medical bed having a pair of spaced ends and a pair of opposed sides connecting the ends. At least one of the sides has a top rail, a bottom rail and a plurality of spaced vertical bars extending therebetween to form a plurality of unobstructed vertical spaces. A part of the top rail extending over one or more of the unobstructed vertical spaces is movable to form an opening at the top through which tubes and wires connected between a person in the bed and medical devices outside of the bed may be moved without disconnecting them from the person when the person is moved.

12 Claims, 3 Drawing Sheets

MEDICAL BED WITH OPENABLE TOP RAIL

FIELD OF THE INVENTION

The present invention relates to a medical bed and, more particularly, to a medical bed having an openable top rail on one or both sides to accommodate tubes and wires which may be attached to a person in the bed.

BACKGROUND OF THE INVENTION

Various types of medical beds, including cribs, are currently available for use in hospitals, medical facilities and the like. In situations where a person in a medical bed or a child in a crib needs to be connected to various tubes and/or monitor wires, such tubes and/or wires conventionally are passed through vertical bars underneath the top rail in a side of the bed or crib. Each time a person or a child is taken out or put back in such a bed or crib, the tubes and/or wires need to be detached and reattached. This process can create many problems.

For example, the detaching and reattaching of tubes such as IV tubing, feeding tubing, vent tubing, etc. so that the tubes can pass over or under the top rail of a bed creates a situation where the tubes can be contaminated by bacteria or other contaminates. Also, a person on tubes goes without the material which is passing through the tubes such as food, oxygen and the like while the tubes are detached in order to remove the person from a bed where the tubes are passed through the vertical bars in a medical bed. In addition, many tube and monitor devices have alarms on them that go off when they are detached. This can easily awaken a person being removed or transferred from a medical bed. Still other problems result when an emergency rises and medical personnel have a tendency to quickly drop the side of a medical bed down in order to reach in and work on a person since there isn't time to detach each tube and monitor wire. In such situations, the tubes and wires often get detached from the person's body.

Moreover, because a substantial amount of time is required to disconnect and reconnect tubes and/or wires attached to a person such as a child, a child with such tubes and/or wires attached tends to get held less. Also, many medical personnel, particularly volunteers, do not want to be responsible or may be afraid of disconnecting any tubes or wires attached to a child. Consequently, less holding of such a child can lead to other problems such as muscular contractions. Moreover, medical institutions waste substantial time and money paying professionals to disconnect and reconnect wires and/or tubing each time a child is taken out of a crib.

SUMMARY OF THE INVENTION

It is an object of the present invention to provide a medical bed having a top rail or rails which may be readily opened or removed to permit tubes and/or wires connected to a person in the bed to pass through the top of a side of the bed without being detached from the person when the person is moved.

Another object of the present invention is to provide a medical bed which is of simple construction and yet provides ready access to the interior thereof in case of a medical emergency.

A further object of the present invention is to provide a medical bed having a side with at least one top rail which either may be partially opened or entirely removed when necessary.

The present invention achieves the above and other objects by providing a medical bed having a pair of spaced ends, a pair of opposed sides connecting the ends and at least one of the sides having a top rail, a bottom rail and a plurality of spaced vertical bars extending therebetween to form a plurality of unobstructed vertical spaces between the top and bottom rails. A part of the top rail extending over one or more of the unobstructed vertical spaces is movable to form an opening at the top of one or more of the vertical spaces.

The part of the top rail which is movable may take various forms. The movable portion may be pivotally connected at one end for movement in a horizontal plane, may be pivotally connected at one end for movement in a vertical plane, may be removable from the bed or may be telescopically connected at one end to slide longitudinally. A part of the bottom rail also may be pivotally movable and connected to a pivotally movable part of the top rail to form a gate which pivots in a horizontal plane. In still another embodiment, the entire top rail may be removable. The bed also may be constructed so that either or both sides may be lowered from a normal upper position to a lower position for more ready access to the bed.

DESCRIPTION OF THE PREFERRED EMBODIMENTS

Figure 1:
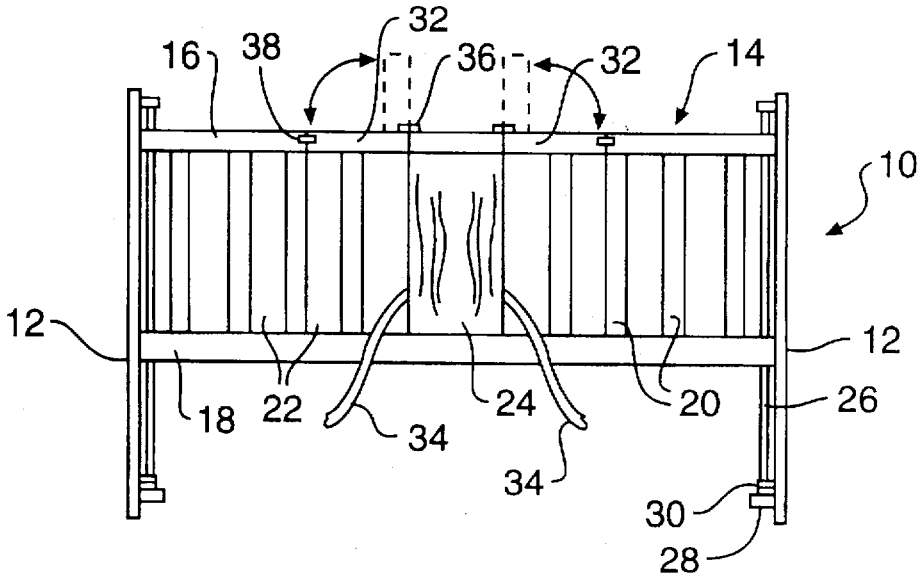
FIG. 1 is a side elevational view of a medical bed according to the present invention illustrating portions of a top rail which may be pivoted in a vertical plane.

Referring to the drawings, a medical bed in the form of a crib, generally referred to by the numeral 10, having a pair of spaced ends 12 connected by a pair of opposed sides 14 is shown in FIG. 1. At least one of the sides comprises a top rail 16 and a bottom rail 18 connected by a plurality of spaced vertical bars 20. The vertical bars 20 form a plurality of unobstructed vertical spaces 22 therebetween. Preferably the side has a solid portion 24 in the center thereof. Although a crib is shown to illustrate the present invention, it will be understood the invention is applicable to medical beds having sides with top and bottom rails connected by a plurality of spaced vertical bars.

In the embodiment shown in FIG. 1, at least one of the sides 14 is slidable from a normal upper position to a lower position to permit easier access to the interior of the crib. A rod 26 is attached to each end 12 of the crib by suitable brackets 28 attached to the ends. Springs 30 are supported on the brackets 28 for engaging the bottom of side 14 when it is lowered.

The top rail 16 of the embodiment shown in FIG. 1 is provided with one or more movable portions 32 which may be pivoted in a vertical plane as shown by the dotted lines in FIG. 1. Each movable portion 32 may extend across one or more vertical spaces 22 whereby when a movable portion is pivoted upwardly one or more of the spaces are open at the top.

This feature is very advantageous in that a child in a crib undergoing medical treatment often is connected to tubes and/or monitoring wires 34 which extend through one or more of the vertical spaces 22 to be connected to other medical equipment (not shown).

With this construction, whenever it is desired to remove a child from the crib without disconnecting any tubes or wires, the moveable parts 32 of the top rail may simply be pivoted to an upward, open position and the tubes pass through the openings at the top of the vertical spaces as the child is lifted. If desired, the entire side 14 may be lowered as well as the moveable parts 32 opened when it is desired to have access to and/or lift a child in the crib. Accordingly, a child may be picked up and/or removed from the crib without detaching any wires or tubes to which the child may be connected.

The movable parts 32 may be connected by appropriate means such as hinges 36 to an adjacent portion of the top rail. Moreover, suitable locking means 38 may be provided at the free end of the movable part 32 and an adjacent part of the top rail to lock the movable part in position when it is closed.

Figure 2:
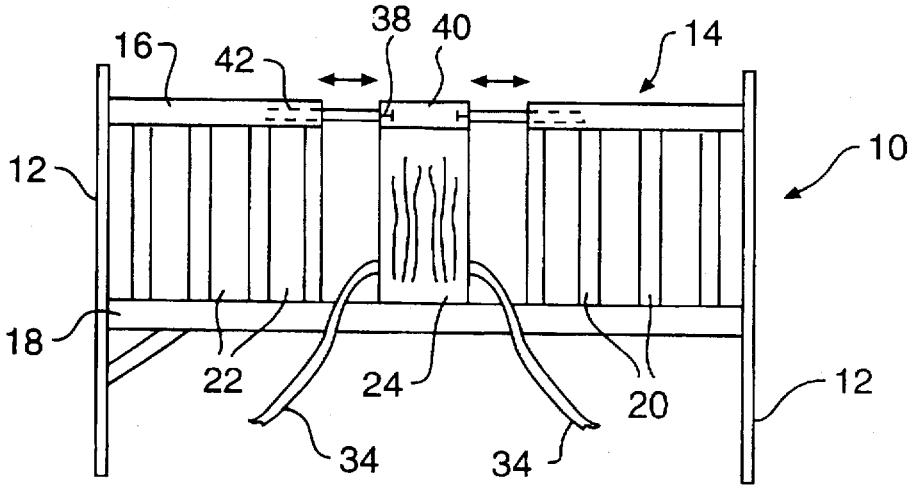
FIG. 2 is a side elevational view of another embodiment of a medical bed according to the present invention illustrating portions of the top rail telescopically connected together for sliding longitudinal movement.

In the embodiment shown in FIG. 2, the movable portion of the top rail is comprised of a section 40 which is telescopically received in an adjacent portion of the top rail. In this construction, the movable telescoping portion 40 is slidably received within an opening or channel 42 formed in an adjacent part of the top rail 16. Although the drawing shows the telescoping portion 40 as only extending over one of the vertical spaces, the telescoping portion may be enlarged to extend over more than one of the spaces 22. Moreover, in this embodiment, the side 14 of the crib is fixed rather than being slidable downwardly. Suitable locking means 38 also may be provided to lock each telescoping portion 40 to an adjacent part of the top rail.

Although the embodiments shown in FIGS. 1 and 2 only illustrate one side of the crib as having a movable top rail portion, both sides of the crib may have a similar construction.

Figure 3:
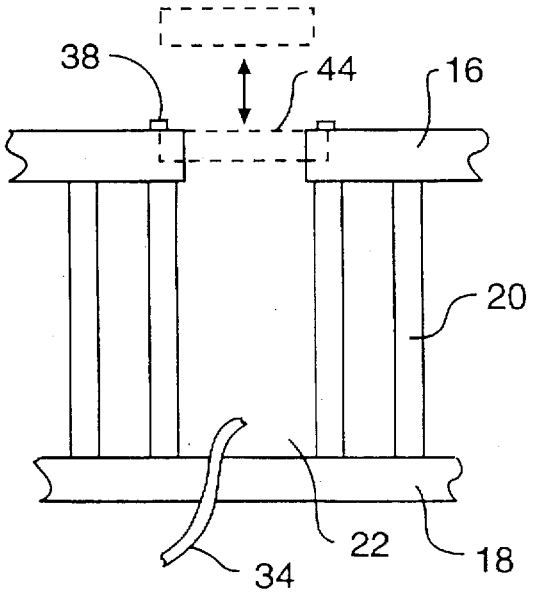
FIG. 3 is an enlarged side view of a portion of a side of a medical bed according to the present invention showing the top rail having a removable part.

In the embodiment shown in FIG. 3, the movable part 44 of the top rail is entirely removable from the top rail as shown in the dotted lines. When the movable part 44 is in position connected to the rest of the top rail, suitable locking means 38 may be provided at each end to maintain the movable part in position. As with the other embodiments the movable part 44 may extend over more than one space 22 so that when the movable part 44 is removed, more than one space is opened at the top.

Figure 4:
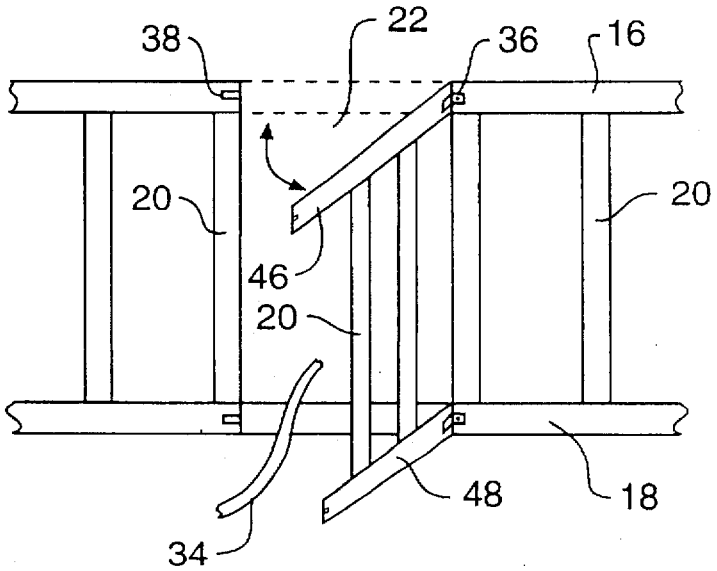
FIG. 4 is a side elevational view of a portion of a side of a medical bed according to the present invention illustrating a horizontally pivotable gate in the side of the bed.

In the embodiment shown in FIG. 4, the top rail 16 is provided with a hinged movable part 46 and the bottom rail 18 is provided with another hinged movable part 48 and the two movable parts 46 and 48 are connected by one or more vertical bars 20 to form a gate which may be pivoted in a horizontal plane to an open position. Again, suitable locking means 38 may be provided at the ends of one or both movable parts 46 and 48 and the adjacent sections of the top and bottom rails. As shown in FIG. 4, any tubes or wires 34 may be inserted between a fixed vertical bar 20 and a movable bar 20 connected between hinged movable parts 46 and 48 whereby when the gate is opened, the tubes and/or wires 34 may be removed through the open space in the top rail 16 created by the opening of the gate.

Figure 5:
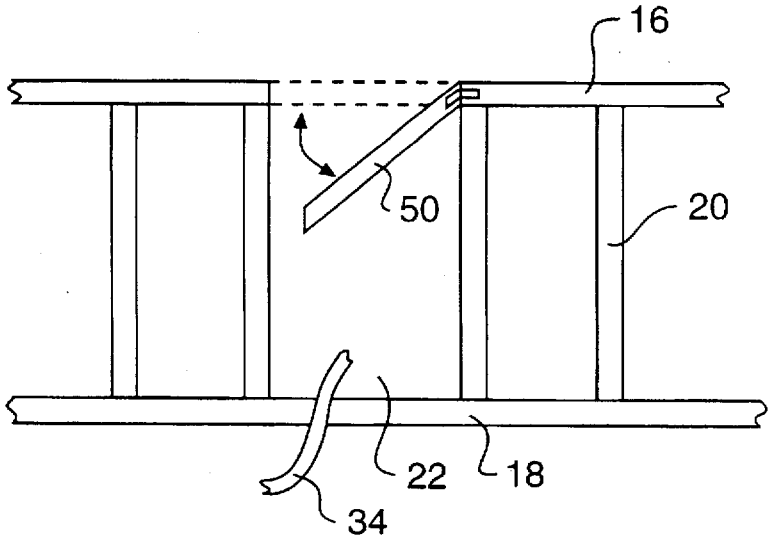
FIG. 5 is an enlarged side view of a portion of a side of a bed according to the present invention illustrating a portion of the top rail which may be pivoted in a horizontal plane.

In the embodiment shown in FIG. 5, only a single movable part 50 is hingidly connected to an adjacent portion of the top rail 16.

Figure 6:
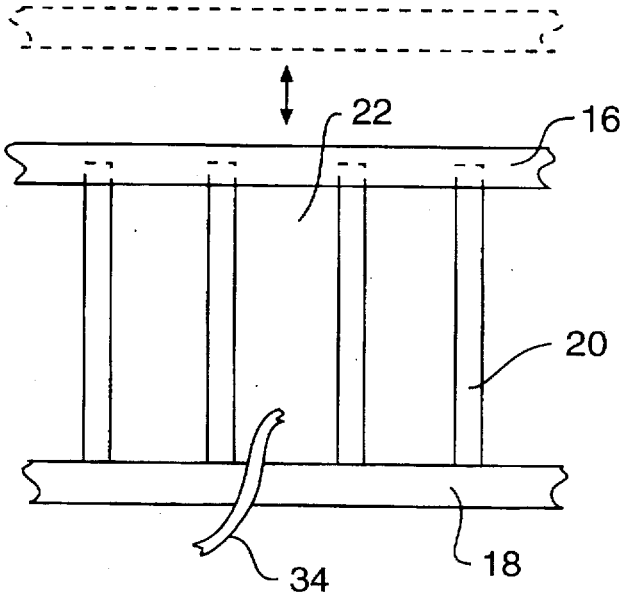
FIG. 6 is a side elevational view of a portion of a side of a bed according to the present invention illustrating a top rail which is entirely removable.

In the embodiment shown in FIG. 6, the entire top rail may be removed whereby all of the vertical spaces in the crib are open at the top.

Numerous other modifications and adaptions of the present invention will be apparent to those skilled in the art and thus, it is intended by the following claims to cover all such modifications and adaptions which fall within the true spirit and scope of the invention.

I claim:

1. A bed comprising:

a pair of spaced ends, a pair of opposed sides connecting said ends, and at least one of said sides having a top rail, a bottom rail and a plurality of spaced vertical bars extending between said top and bottom rails, said vertical bars forming a plurality of unobstructed vertical spaces between said top and bottom rails, and at least a part of said top rail extending over one or more of said unobstructed vertical spaces, said part of said to rail being movable away from said one or more unobstructed vertical spaces while said vertical bars remain stationary, to form an opening at the top of said one or more unobstructed vertical spaces.

2. A bed according to claim 1, wherein said part of said top rail which is movable is pivotally connected at one end to an adjacent part of said top rail.

3. A bed according to claim 2, wherein said part of said top rail is pivotally connected for pivoting in a horizontal plane.

4. A bed according to claim 2, wherein said part of said top rail is pivotally connected for pivoting in a vertical plane.

5. A bed according to claim 1, wherein said part of said top rail which is movable is completely removable from said crib.

6. A bed according to claim 1, wherein said part of said top rail which is movable is telescopically connected at one end to an adjacent part of said top rail.

7. A bed according to claim 1, wherein the entirety of said top rail is removable.

8. A bed according to claim 1, which further includes means for lowering said one of said sides from a normal upper position to a lower position.

9. A bed according to claim 1, wherein both of said sides have a top rail, a bottom rail and a plurality of spaced vertical bars extending therebetween, said vertical bars forming a plurality of unobstructed vertical spaces between said top and bottom rails and at least a part of said top rail extends over one or more of said unobstructed vertical spaces, said part of said top rail being movable away from said one or more unobstructed vertical spaces while said vertical bars remain stationary, to form an opening at the top of said one or more unobstructed vertical spaces.

10. A bed comprising:

a pair of spaced ends, a pair of opposed sides connecting said ends, and at least one of said sides having a top rail, a bottom rail, an intermediate solid portion and a plurality of spaced vertical bars on both sides of said solid portion extending between said top and bottom rails, said vertical bars forming a plurality of unobstructed vertical spaces between said top and bottom rails, and a part of said top rail extending over one or more of said unobstructed vertical spaces on at least on side of said solid portion and being telescopically connected at one end to an adjacent portion of said top rail whereby said part of said top rail is movable to form an opening at the top of said one or more unobstructed vertical spaces.

11. A bed according to claim 10 wherein a part of said top rail extending over one or more of said unobstructed vertical spaces on each side of said solid portion is telescopically connected at one end to an adjacent portion of said top rail whereby said part of said top rail on each side of said solid portion is movable to form an opening at the top of said unobstructed vertical spaces.

12. A bed according to claim 10 wherein both of said sides have a top rail, a bottom rail, an intermediate solid portion and a plurality of spaced vertical bars on both sides of said solid portion extending between said top and bottom rails, said vertical bars forming a plurality of unobstructed vertical spaces between said top and bottom rails, and a part of said top rail extending over one or more of said vertical spaces on at least one side of said solid portion and being telescopically connected at one end to an adjacent portion of said top rail whereby said part of said top rail is movable to form an opening at the top of said one or more unobstructed vertical spaces.

* * * * *